US010816197B2

(12) United States Patent
Lucas et al.

(10) Patent No.: US 10,816,197 B2
(45) Date of Patent: Oct. 27, 2020

(54) SYSTEM FOR THE DYNAMIC MOVEMENT OF WASTE IN AN INCINERATOR

(71) Applicant: ECO Burn Inc., Burlington (CA)

(72) Inventors: Jean Lucas, Burlington (CA); Jun Xiao, Burlington (CA); Kim Docksteader, Burlington (CA)

(73) Assignee: ECO BURN INC., Bulington (CA)

( * ) Notice: Subject to any disclaimer, the term of this patent is extended or adjusted under 35 U.S.C. 154(b) by 84 days.

(21) Appl. No.: 16/213,631

(22) Filed: Dec. 7, 2018

(65) Prior Publication Data

US 2020/0182462 A1 Jun. 11, 2020

(51) Int. Cl.

| | |
|---|---|
| ***F23G 5/50*** | (2006.01) |
| ***F23G 5/38*** | (2006.01) |
| ***F23G 5/44*** | (2006.01) |
| ***F23H 7/14*** | (2006.01) |

(52) U.S. Cl.

CPC ..... *F23G 5/50* (2013.01); *F23G 5/38* (2013.01); *F23G 5/442* (2013.01); *F23H 7/14* (2013.01); *F23G 2202/10* (2013.01); *F23G 2202/20* (2013.01); *F23G 2203/101* (2013.01); *F23G 2205/12* (2013.01); *F23G 2207/101* (2013.01); *F23G 2207/103* (2013.01); *F23G 2207/112* (2013.01); *F23G 2207/114* (2013.01); *F23G 2900/55006* (2013.01)

(58) Field of Classification Search

CPC ... F23G 5/50; F23G 5/38; F23G 5/442; F23G 2202/10; F23G 2202/20; F23G 2900/55006; F23G 2205/12; F23G 2207/101; F23G 2207/103; F23G 2207/114; F23G 2207/112; F23G 2203/101; F23G 2205/10; F23G 5/444; F23H 7/14

See application file for complete search history.

(56) References Cited

U.S. PATENT DOCUMENTS

| | | | | |
|---|---|---|---|---|
| 4,838,183 | A * | 6/1989 | Tsaveras | F23G 5/002 110/101 C |
| 4,901,653 | A * | 2/1990 | Baltzinger | F23B 1/18 110/281 |
| 5,044,288 | A * | 9/1991 | Barlow | F23G 5/002 110/300 |
| 5,307,746 | A * | 5/1994 | Khinkis | F23G 5/002 110/245 |
| 6,067,916 | A * | 5/2000 | Martin | C10J 3/20 110/348 |
| 6,981,455 | B2 * | 1/2006 | Lefcort | F23G 5/002 110/101 R |
| 7,832,342 | B2 * | 11/2010 | Martin | F23L 7/007 110/204 |
| 10,047,954 | B2 * | 8/2018 | Kobayashi | F23G 5/0276 |
| 10,180,254 | B2 * | 1/2019 | Brennwald | F23G 5/002 |

(Continued)

*Primary Examiner* — David J Laux

(74) *Attorney, Agent, or Firm* — Slayden Grubert Beard PLLC

(57) ABSTRACT

The present invention discloses a system for the dynamic movement of waste through an incinerator. The system includes a stepped hearth combustion chamber, an input to receive a combustible material, and an output to permit egress of a product of combustion. A plurality of sensing elements and response elements are in communication with a control system to facilitate the automated movement of the combustible material through the stepped hearth combustion chamber.

20 Claims, 4 Drawing Sheets

(56) References Cited

U.S. PATENT DOCUMENTS

| | | | | |
|---|---|---|---|---|
| 10,386,064 | B2 * | 8/2019 | Mawatari | F23G 5/04 |
| 2010/0122643 | A1 * | 5/2010 | Cole | F23G 5/444 110/298 |
| 2014/0182492 | A1 * | 7/2014 | Waldner | F23L 9/00 110/346 |

* cited by examiner

SYSTEM FOR THE DYNAMIC MOVEMENT OF WASTE IN AN INCINERATOR

TECHNICAL FIELD

The embodiments presented relate to incinerators for waste reduction, and more specifically, relates to incinerators having dynamic systems for controlling the waste movement in a stepped hearth incinerator.

BACKGROUND

Traditional incinerators have been used in the United States since the early 19$^{th}$ century as a means for converting waste materials into ash, flue gas, and waste heat by combusting organic substances within a loaded waste material. Initial forms were as simple as a burn pile or combustion container and required the manual input of organic material and removal of the waste product following incineration. These systems were quickly adopted in numerous municipalities, and in industrial/commercial operations. An efficient incinerator in the current arts can reduce the solid mass of the original waste by 80-85% and the volume by 95-96%, depending on the composition and degree of recovery of materials. This significantly lessens the burden placed landfills.

Due to increased demands for safe, efficient, and effective waste removal, the technologies surrounding incinerators has advanced significantly. In the current arts, many incinerators include a number of mechanical components to aid in the loading, movement, and removal of waste materials. In general, the prior art fails to disclose real-time controls of the operational mechanisms via an analytic processing system including dynamic and reactive movement of the ash transfer rams and moving hearths. Further, the dynamic and reactive modulation of gas temperature and oxygen levels in response to loaded waste material composition and temperature has not been disclosed. Specifically, the current art fails to disclosure real-time control of cycle times, the stroke length of the loading rams, exhaust output, and other systems involved in the incinerators.

SUMMARY OF THE INVENTION

This summary is provided to introduce a variety of concepts in a simplified form that is further disclosed in the detailed description of the invention. This summary is not intended to identify key or essential inventive concepts of the claimed subject matter, nor is it intended for determining the scope of the claimed subject matter.

In one aspect, a system for the dynamic movement of waste through an incinerator includes a stepped hearth combustion chamber having an input to receive a combustible material, in addition to an output to permit egress of a product of combustion. Sensing elements and response elements are provided along with a control system which receives input signals from the sensing elements to affect the response elements. The control system provides an efficient incinerator system which improves the quality of the product of combustion.

In one aspect, the control system is comprised of a programmable logic controller, and a hydraulic control system. The response elements include at least one loading ram for loading combustible materials into the stepped hearth combustion chamber, at least one ash transfer ram for moving the combustible material through the stepped hearth combustion chamber, and at least one flue gas recirculation and air injection systems for controlling the temperatures of solid combustible materials on each hearth. Further, the temperature and oxygen content of primary gas within the stepped hearth combustion chamber is monitored and controlled.

In another aspect, the sensing elements include at least a temperature sensor, a gas oxygen content sensor, and a level sensor. Each sensing element sends an output signal to the programmable logic controller. The output signal is compared with at least one threshold value stored in the programmable logic controller to affect at least one of the plurality of response elements.

In one aspect, the temperature sensor is a non-contact infrared temperature sensor for measuring the surface temperature of the combustible materials and the inner surface of the stepped hearth combustion chamber. Further, the level sensor is a non-contact level sensor providing continuous combustible material level monitoring.

In yet another aspect, at least one high-temperature imaging camera is provided for observing the combustible material within the stepped hearth combustion chamber. The imaging camera can include a pyrometer.

Moreover, in accordance with a preferred embodiment of the present invention, other aspects, advantages, and novel features of the present invention will become apparent from the following detailed description in conjunction with the drawings.

BRIEF DESCRIPTION OF THE DRAWINGS

A more complete understanding of the present invention and the advantages and features thereof will be more readily understood by reference to the following detailed description when considered in conjunction with the accompanying drawings wherein.

DETAILED DESCRIPTION

Figure 1:
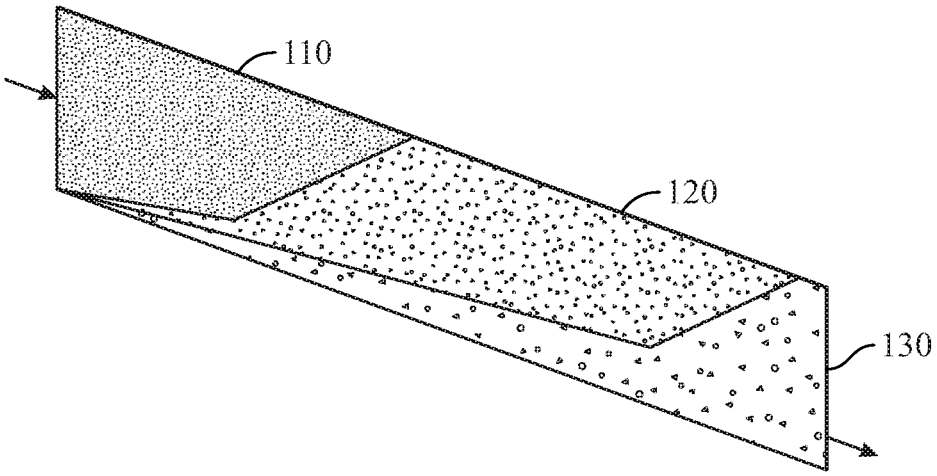
FIG. 1 illustrates a schematic of the movement of waste materials through the dynamic waste movement incinerator, according to some embodiments.

The specific details of the single embodiment or variety of embodiments described herein are to the described system and methods of use. Any specific details of the embodiments are used for demonstration purposes only and not unnecessary limitations or inferences are to be understood therefrom.

No single embodiment includes features that are necessarily included in all embodiments unless otherwise stated. Furthermore, although there may be references to "advantages" provided by some embodiments, other embodiments may not include those same advantages or may include different advantages. Any advantages described herein are not to be construed as limiting to any of the claims.

Before describing in detail exemplary embodiments, it is noted that the embodiments reside primarily in combinations of components related to the system. Accordingly, the system components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second" and the like, may be used solely to distinguish one entity or element from another entity or element without necessarily requiring or implying any physical or logical relationship or order between such entities or elements.

In general, some embodiments provide for a system which uses real-time operating conditions data to modulate the movement of loaded combustible materials through a combustion chamber. Waste movement throughout the chamber can be facilitated using a plurality of response elements, such as hydraulic rams to move loaded combustible material along a stepped hearth combustion chamber. The system can operate as a continuously or intermittently moving flow of combustible materials.

A used herein, the term "sensing element" is defined to describe any element of the system configured to sense a characteristic of a process, a process device, a process input or process output, wherein such characteristic may be represented by a characteristic value useable in monitoring, regulating and/or controlling one or more local, regional and/or global processes of the incinerator system. Sensing elements considered within the context of an incinerator system may include, but are not limited to, sensors, detectors, monitors, analyzers or any combination thereof for the sensing of process, fluid and/or material temperature, pressure, flow, composition and/or other such characteristics, as well as material position and/or disposition at any given point within the system and an operating characteristic of any process device used within the system. It will be appreciated by the person of ordinary skill in the art that the above examples of sensing elements, though each relevant within the context of an incinerator system, may not be specifically relevant within the context of the present disclosure, and as such, elements identified herein as sensing elements should not be limited and/or inappropriately construed in light of these examples.

As used herein, the term "response element" is defined to describe any element of the system configured to respond to a sensed characteristic in order to operate a process device operatively associated therewith in accordance with one or more pre-determined, computed fixed and/or adjustable control parameters, wherein the one or more control parameters are defined to provide the desired process result. Response elements considered within the context of an incinerator system may include, but are not limited to static, pre-set and/or dynamically variable drivers, power sources, and any other element configurable to impart an action, which may be mechanical, electrical, magnetic, pneumatic, hydraulic or a combination thereof, to a device based on one or more control parameters. Process devices considered within the context of an incineration system, and to which one or more response elements may be operatively coupled, may include, but are not limited to, material input means, heat sources, additive input means, various gas blowers and/or other such gas circulation devices, various gas flow and/or pressure regulators, and other process devices operable to affect any local, regional and/or global process within an incinerator system. It will be appreciated by the person of ordinary skill in the art that the above examples of response elements, though each relevant within the context of an incinerator system, may not be specifically relevant within the context of the present disclosure, and as such, elements identified herein as response elements should not be limited and/or inappropriately construed in light of these examples.

in reference to FIG. 1, the general flow of the combustible material through the combustion chamber is shown. Characteristics, including the density, height, mass, moisture content, temperature, volume, etc. of the combustible changes during the incineration process. The combustible material, such as a form of solid waste, enters the chamber and is preheated and dried at zone 110. Once dried, the combustible material is transferred to the combustion zone 120. Following combustion, the combustible material is then transferred to the ash zone 130 for removal of ash from the incineration process.

Figure 2:
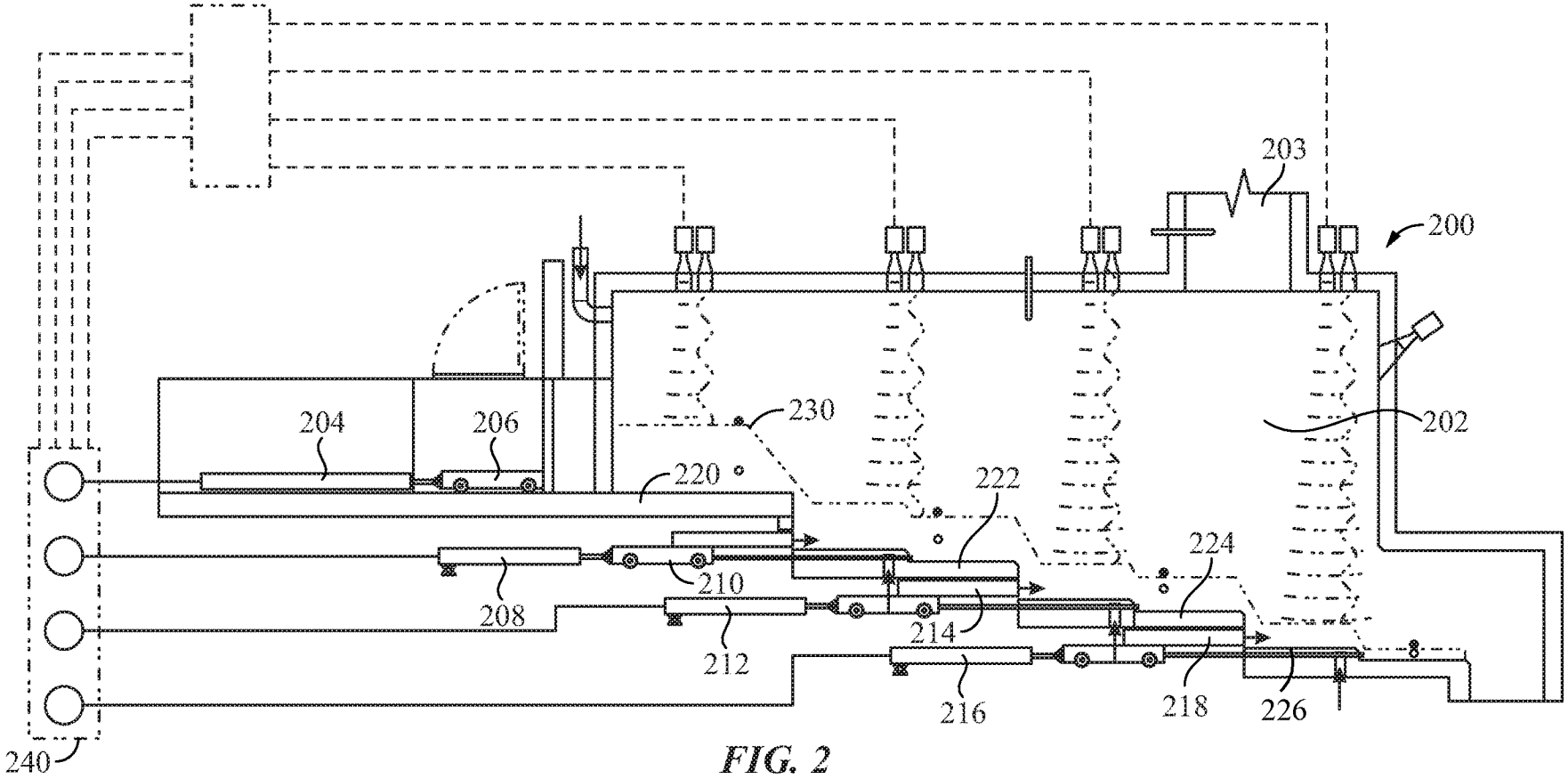
FIG. 2 illustrates a schematic of the dynamic waste movement incinerator and hydraulic control systems, according to some embodiments.

In one embodiment, the combustible material is loaded and transferred through the incinerator. FIG. 2 provides a plurality of response elements within the incinerators 200 primary chamber 202 wherein combustible materials are dried, combusted, and ash is produced. The incinerator 200 and primary chamber 202 can be constructed of any configuration known in the arts. In the present embodiment, the primary chamber 202 is a rectangular enclosure having a plurality of layers of refractory lining on the interior surfaces. Each stage of the process shown in zones 110, 120, and 130 shown in FIG. 1 occurs within the primary chamber 202. This includes drying, combustion, and the burn-out to ash. A secondary chamber 203, having an elevated temperature, facilitates further oxidation of the ash.

In a preferred embodiment, the primary chamber 202 includes a one or more stepped hearths. First, a loading ram 206 facilitates the loading of combustible materials into the primary chamber 202 via a first hydraulic cylinder 204. The hydraulic cylinder provides lateral force to the loading ram 206 such that the combustible material is moved to the first hearth 220. The material is heated at the first hearth 220, and moved to the second hearth 222, via the first ash transfer ram 210 which forces the lateral motion of the combustible material via the second hydraulic cylinder 208. In the preferred embodiment, the stepped hearth incinerator 200 is configured having a slope such that combustible materials move downward at each subsequent step. Any number of hearth steps can be provided. In the present embodiment, the incinerator 200 includes a third hearth 224, third ash transfer ram 214, and third hydraulic cylinder 212. Further, a fourth hearth 226, fourth ash transfer ram 218 and fourth hydraulic cylinder 216 are provided. Each hydraulic cylinder 204, 208, 212, 216 are in operable communication with a hydraulic cylinder control system 230 which facilitates independent movement of each hydraulic cylinder 204, 208, 212, 216 providing impetus to respective loading ram 206 and ash transfer rams 210, 214, 218. The bottom ash can be removed from the incinerator 200 using one or more ash conveyors which can include belts, or chains as known in the arts.

In some embodiments, hydraulic cylinders 204, 208, 212, 216 can include double-action hydraulic cylinders, oil pumps, tanks, valve trains and control systems. Automatic or manual shut off valves, relief valves, throttle valves, motors, indicators, transmitters, and sensors can be provided as known in the hydraulic arts. In some embodiments, the moving element can include but is not limited to, a shelf/platform, pusher ram or carrier rams, plow, screw element, conveyor or a belt. The rams can include a single ram or multiple-finger ram.

The material is moved through the primary chamber 202 in order to promote specific stages of the incineration process (drying, combustion, ash conversion). To facilitate control of the incineration process, material movement through the primary chamber 202 can be varied (variable movement) depending on process requirements. This lateral movement of material through the incinerator 200 is achieved via the use of a lateral transfer system comprising one or more lateral transfer units. Movement of reactant material by the lateral transfer system can be optimized by varying the movement speed, the distance a lateral transfer unit moves, and the sequence in which the plurality of lateral transfer units are moved in relation to each other. The one or more lateral transfer units can act in a coordinated manner, or individual lateral transfer units can act independently. To facilitate control of the material flow rate and pile height the individual lateral transfer units can be moved individually, at varying speeds, at different movement distances, and at varying frequency of movement.

Figure 3:
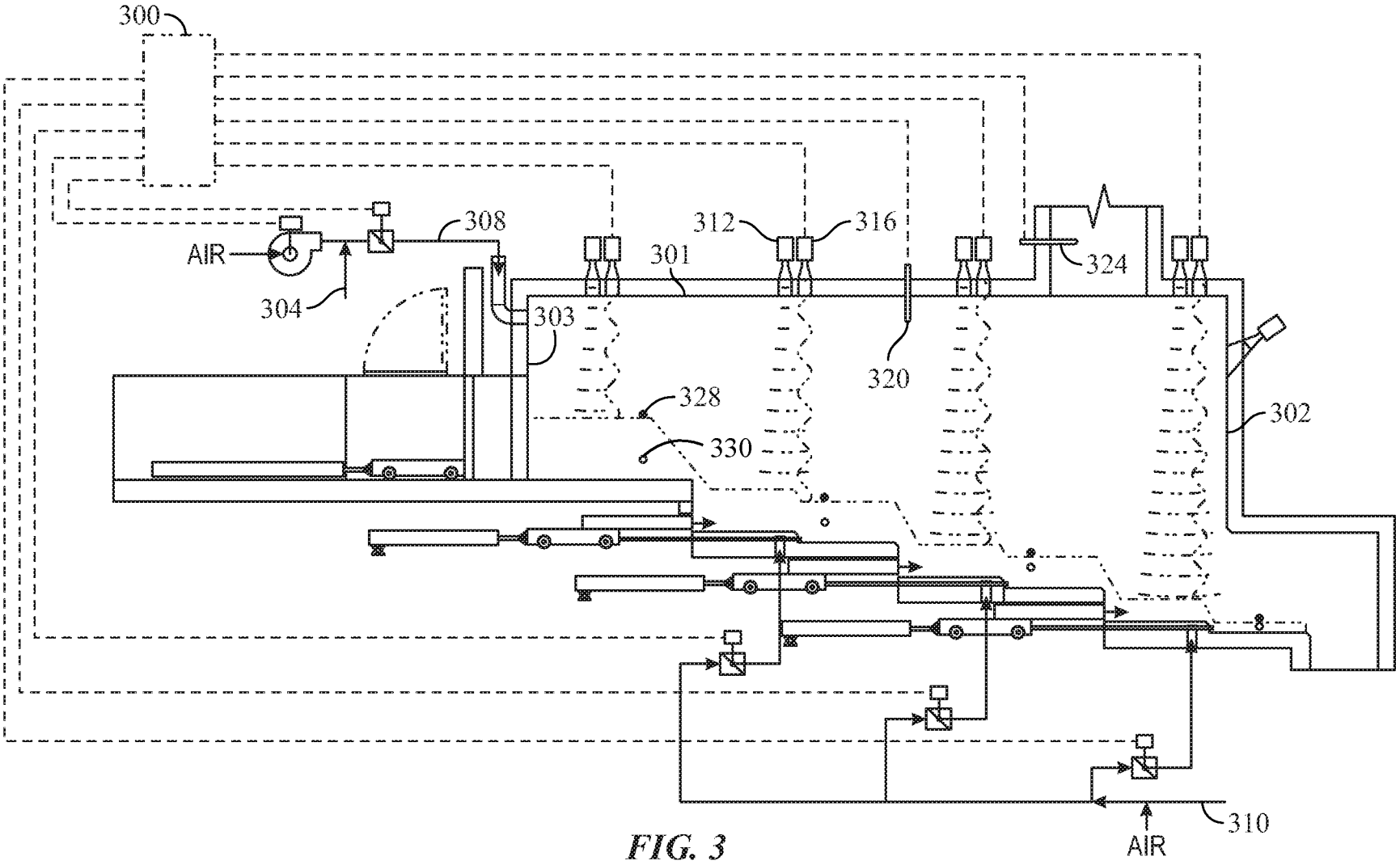
FIG. 3 illustrates a schematic of the dynamic waste movement incinerator including sensing elements, the air injection system, and the flue gas recirculation system, according to some embodiments.

It is a goal of some embodiments to provide a substantially autonomous system for the movement of combustible materials through the incinerator 200. As combustible material burns, its characteristics will change. Characteristics can include the appearance, mass, volume, weight, and temperature. To achieve the best production of combustion (gas) and ash quality, these characteristics can be monitored and analyzed to affect the response elements within the incinerator. FIG. 3 provides a plurality of sensing elements in communication with a programmable logic controller 300. Each sensing element can be positioned on any one of the interior surfaces of the primary combustion chamber 202.

In one embodiment, the sensing elements can include a plurality of level sensors positioned on the upper surface 301 or sidewall 302 of the primary chamber 202. The plurality of level sensors can include non-contact, continuous measurement level sensors, contact continuous measurement level sensors, non-contact single point measurement level sensors, contact single point measurement level sensors, microwave sensors, radar sensors, ultrasonic sensors, capacitance level sensors, etc. and any combination of such sensors. In the present embodiment, a non-contact level sensor 312 is illustrated measuring the change in combustible material level at the second hearth 222. A contact level sensor 328 is illustrated measuring the change in combustible material level at the first hearth 220. Additional load cells may be provided to monitor the weight of the combustible material at one or more of the hearths 220, 222, 224, 226.

In one embodiment, the plurality of level sensors can include a temperature reduction means, such as a cooling fluid or air device to reduce the temperature of the sensors.

The PLC 300 is provided to receive input from each sensing element and output control signals to the hydraulic control system 240 which controls the response elements. Control of the response elements can include stroke length, movement speed, and timing. In one embodiment, the PLC is in communication with a universal means of remote access to the variety of local control modules. This can include a system such as a supervisory control and data acquisition (SCADA) system architecture, or similar implements known in the PLC associated arts.

The sensing elements can include a plurality of temperature sensors which are provided on the upper surface 301 or sidewall 302 of the incinerator 200. Each temperature sensor is configured to monitor the required temperature parameter including surface temperatures of combustible materials on the hearths 220, 222, 224, 226, internal temperatures of combustible materials, primary gas temperatures. The temperature sensors can further include oxygen content sensors 324 positioned in the secondary chamber 203. In the illustrated embodiment, an infrared thermometer 316 is illustrated measuring the temperature of combustible materials on the second hearth 222. Further, a contact temperature sensor 330 is shown measuring the internal temperature of the combustible material on the first hearth 220. In some embodiments, the plurality of infrared temperature sensors 316 can be point source, line scan, or area scan. The plurality of contact temperature sensors 330 can be inserted through a sidewall of the incinerator 200 or disposed within the hearths 220, 222, 224, 226.

Each sensing element provides input to the PLC 300 which, in turn, provides a control signal output to a plurality of control devices. Control devices can include under fire flue gas recirculation systems 310, each in communication with a hearth 220, 222, 224, 226. The under fire flue gas recirculation system 310 can include gas nozzles, gas dampers, modular motors, in addition to hydraulic or pneumatic devices. A plurality of above fire flue gas systems 304, 308 are similarly provided.

The control system generally comprises one or more central, networked and/or distributed processors, one or more inputs for receiving current sensed characteristics from the various sensing elements, and one or more outputs for communicating new or updated control parameters to the various response elements. The one or more computing platforms of the control system may also comprise one or more local and/or remote computer readable media (e.g. ROM, RAM, removable media, local and/or network access media, etc.) for storing various predetermined and/or readjusted control parameters set or preferred system and process characteristic operating ranges, system monitoring and control software, operational data, and the like. Optionally, the computing platforms may also have access, either directly or via various data storage devices, to process simulation data and/or system parameter optimization and modeling means. Also, the computing platforms may be equipped with one or more optional graphical user interfaces and input peripherals for providing managerial access to the control system (system upgrades, maintenance, modification, adaptation to new system modules and/or equipment, etc.), as well as various optional output peripherals for communicating data and information with external sources (e.g. modem, network connection, printer, etc.).

As used herein, the term, "input" denotes that which is about to enter or be communicated to any system or component thereof, is currently entering or being communicated to any system or component thereof, or has previously entered or been communicated to any system or component thereof. An input includes but is not limited to, compositions of matter, information, data, and signals, or any combination thereof. In respect of a composition of matter, an input may include but is not limited to, influent(s), reactant(s), reagent (s), fuel(s), object(s) or any combinations thereof. In respect of information, an input may include but is not limited to, specifications and operating parameters of a system. In respect of data, an input may include, but is not limited to, result(s), measurement(s), observation(s), description(s), statistic(s), or any combination thereof generated or collected from a system. In respect of a signal, an input may include but is not limited to, pneumatic, electrical, audio, light (visual and non-visual), mechanical or any combination thereof. An input may be defined in terms of the system, or component thereof, to which it is about to enter or be communicated to, is currently entering or being communicated to, or has previously entered or been communicated to, such that an input for a given system or component of a system may also be an output in respect of another system or component of a system. Input can also denote the action or process of entering or communicating with a system.

As used herein, the term "output" denotes that which is about to exit or be communicated from any system or component thereof, is currently exiting or being communicated from any system or component thereof, or has previously exited or been communicated from any system or component thereof. An output includes, but is not limited to, compositions of matter, information, data, and signals, or any combination thereof. In respect of a composition of matter, an output may include but is not limited to, effluent (s), reaction product(s), process waste(s), fuel(s), object(s) or any combinations thereof. In respect of information, an output may include but is not limited to, specifications and operating parameters of a system. In respect of data, an output may include, but is not limited to, result(s), measurement(s), observation(s), description(s), statistic(s), or any combination thereof generated or collected from a system. In respect of a signal, an output may include but is not limited to, pneumatic, electrical, audio, light (visual and non-visual), mechanical or any combination thereof. An output may be defined in terms of the system, or component thereof, to which it is about to exit or be communicated from, currently exiting or being communicated from, or has previously exited or been communicated from, such that an output for a given system or component of a system may also be an input in respect of another system or component of a system. Output can also denote the action or process of exiting or communicating with a system.

In corrective, or feedback, control the value of a control parameter or control variable, monitored via an appropriate sensing element, is compared to a specified value or range. A control signal is determined based on the deviation between the two values and provided to a control element in order to reduce the deviation. It will be appreciated that a conventional feedback or responsive control system may further be adapted to comprise an adaptive and/or predictive component, wherein response to a given condition may be tailored in accordance with modeled and/or previously monitored reactions to provide a reactive response to a sensed characteristic while limiting potential overshoots in compensatory action. For instance, acquired and/or historical data provided for a given system configuration may be used cooperatively to adjust a response to a system and/or process characteristic being sensed to be within a given range from an optimal value for which previous responses have been monitored and adjusted to provide the desired result. Such adaptive and/or predictive control schemes are well known in the art, and as such, are not considered to depart from the general scope and nature of the present disclosure.

During processing, air as a source of oxygen is introduced into the chamber. Optionally, the method of injecting air can be selected to facilitate an even flow of air into the incinerator, prevent hot spot formation and/or improve temperature control. The air can be introduced through the sides of the chamber, optionally from near the bottom of the chamber, or can be introduced through the floor of the chamber, or through both.

Figure 4:
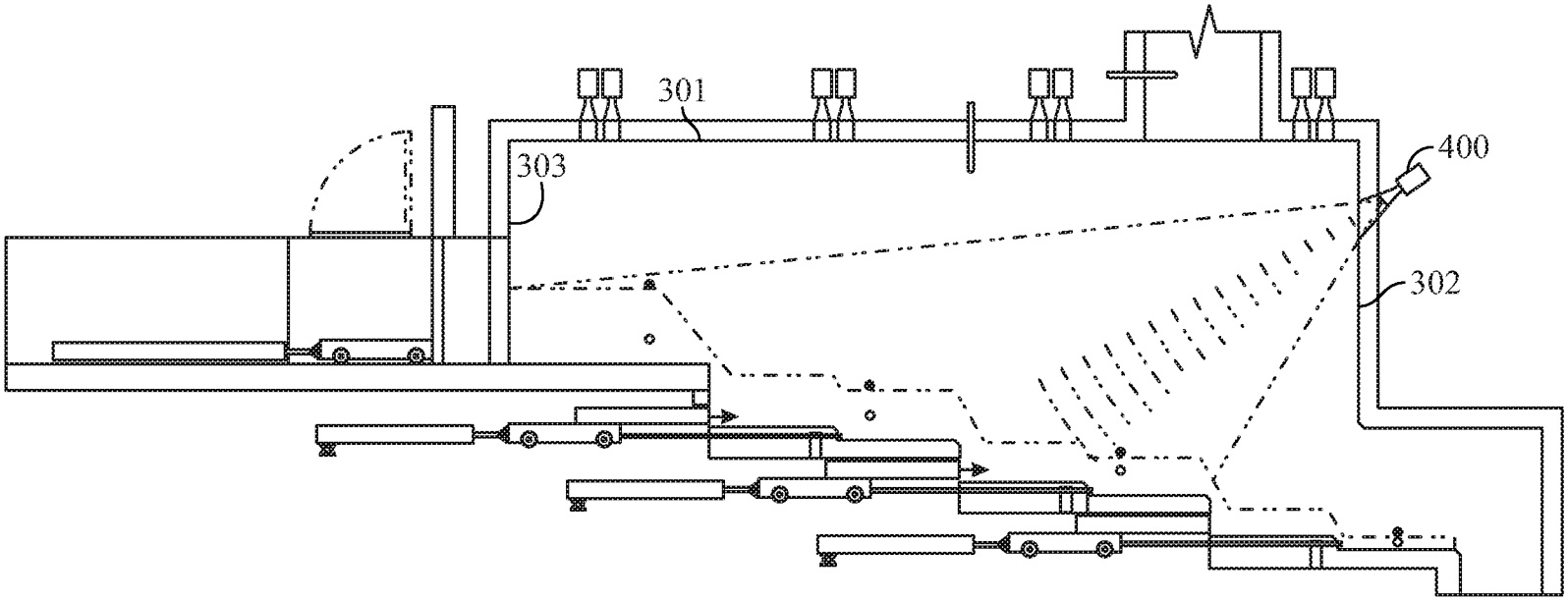
FIG. 4 illustrates a schematic of the dynamic waste movement incinerator and the thermal imaging camera, according to some embodiments.

FIG. 4 illustrates a sensing element configured as a high-temperature imaging pyrometer 400 on the sidewall 302 which can directly monitor the combustible material within the primary chamber 202.

During the incineration process, the sensing elements, and specifically the non-contact and contact level sensors measure the height variation of the combustible material. Each level sensor can include a transmitter to transmit a measurement signal to a standard electrical signal. A cooling element may be in communication with the sensing element to reduce the temperature.

In one embodiment, one or more continuous level sensors are in communication with each hearth 220, 222, 224, 226. The PLC 300 will compare height measurement values with a preset height range including a maximum value, a minimum value, and an average value. A user can adjust the preset height range according to the specific composition of the combustible material. Once a threshold value is reached, the PLC sends an output signal to the hydraulic control system 240 to manage the movements of the loading ram 206, and the transfer rams 210, 214, 218. As the height measurement at one hearth equals the maximum value, the PLC 300 will stop the movement of the upstream transfer ram. Meanwhile, the PLC will move the downstream transfer ram to a maximum length to push the combustible material to the downstream hearth. On the other hand, if the height at a hearth equals the minimum threshold value, the PLC 300 will stop the movement of the transfer ram on the same hearth, while the transfer ram of the upstream hearth will move to a maximum length to push the combustible material to the hearth, thus raising the height measurement above the minimum value. Referring back to FIG. 2, and in one example, a level sensor 312 is positioned above the second hearth 222 to measure the height of the combustible material thereon. If the maximum threshold value is measured by sensor 312, the PLC 300 will stop the movement of the loading ram 206, and will provide an output signal to extend the first ash transfer ram 210. Likewise, if a minimum threshold value is measured by sensor 312, the PLC 300 will provide an output signal to extend the loading ram 206, and will provide an output signal to stop the movement of the first ash transfer ram 210.

In another embodiment, one or more point level sensor can be used in addition to the continuous level sensors. Point level sensors will send a signal output to the PLC 300 once a maximum and a minimum value is reached. The continuous and point level sensors can be used in tandem by having the point level sensor programmed with an alarm set to alert the PLC 300 of maximum and minimum thresholds, while the continuous level sensors monitor changes between the maximum and minimum thresholds.

Temperature measurements and control is facilitated by the plurality of infrared thermometers 316 which can be programmed to continuously, or intermittently measure the surface temperature of the combustible materials. An alternative method for measuring the temperature includes the use of position a point temperature sensor 320 through a surface of the primary chamber 202. Each hearth 220, 222, 224, 226 is provided with at least one temperature sensing element in communication with the PLC 300 which compares the sensed temperature with preset threshold values. When a threshold value is reached, the PLC 300 sends an output signal to the plurality of response elements, including the under fire flue gas recirculation system 310, and the above fire flue gas systems 304, 308. The PLC 300 may instruct the opening or closing of a damper opening to adapt to variations in temperature within the incinerator 200. Preset temperature thresholds may be specific to the particular combustible material within the incinerator 200, and may even be specific to each hearth 220, 222, 224, 226 within the primary chamber 202. In one example, one or more hearths 220, 222, 224, 226 are assigned to a zone 110, 120, 130 (see FIG. 1) requiring unique temperature settings.

In some embodiments, gas temperature can be monitored by one or more of the sensing elements. Similar to the above, threshold values related to gas temperature can be preset by the user. The PLC 300 can control response devices, including gas dampers of the above fire air-flue gas recirculation system 308 to control the temperature of gasses within the primary chamber 202.

The gas oxygen content sensor 324 is positioned within the secondary chamber 203 to monitor the gas oxygen content. The PLC 300 compares gas oxygen content values to preset threshold values related to gas oxygen content. The PLC 300 then sends an output signal to the response elements, including the variable-frequency drive (VFD), which controls the above fire flue gas system 304 by adjusting the rotation speed of blower blades therein. The blower blades rotation adjusts the oxygen content value to ensure combustion efficiency and lower pollutant emissions.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A system for dynamic movement of waste through an incinerator, the system comprising:

a stepped hearth combustion chamber including an input to receive a combustible material an output to permit egress of a product of combustion, and a stair-stepped series of hearths arranged between the input and the output;

a plurality of sensing elements including a level sensor configured to measure a height of the combustible material on a particular hearth of the series of hearths;

a plurality of response elements including a hydraulic ram configured to laterally force the combustible material onto or off of the particular hearth;

a control system configured to control the plurality of response elements in response to signals from the plurality of sensing elements, including:

receiving measurement signals from the level sensor indicating the height of the combustible material on the particular hearth, and controlling a stroke of the hydraulic ram to laterally force a quantity of the combustible material onto or off of the particular hearth as a function of the measured height of the combustible material on the particular hearth, to thereby raise or lower the height of the combustible material on the particular hearth.

2. The system of claim 1, wherein the control system comprises a programmable logic controller, and a hydraulic control system.

3. The system of claim 2, wherein the plurality of response elements includes:

at least one hydraulic loading ram configured to laterally force the combustible materials onto a first hearth in the series of hearths;

at least one hydraulic ash transfer ram, each configured to laterally transfer the combustible material to a downstream, stepped-down hearth in the series of hearths; and at least one flue gas recirculation system for controlling temperatures within the stepped hearth combustion chamber.

4. The system of claim 2, wherein the plurality of sensing elements include at least a temperature sensor, a gas oxygen content sensor, and the level sensor, wherein each sensing element sends an output signal to the programmable logic controller, wherein the output signal is compared with at least one threshold value stored in the programmable logic controller to affect at least one of the plurality of response elements.

5. The system of claim 4, wherein the temperature sensor is a non-contact infrared temperature sensor for measuring the surface temperature of the combustible materials and the inner surface of the stepped hearth combustion chamber.

6. The system of claim 4, wherein the level sensor is a non-contact level sensor providing continuous combustible material level monitoring.

7. The system of claim 4, further comprising at least one high-temperature imaging camera for observing the combustible material within the stepped hearth combustion chamber.

8. The system of claim 7, wherein the at least one high temperate imaging camera includes an infrared pyrometer.

9. The system of claim 1, wherein the stepped hearth combustion chamber comprises three or more zones, including at least the following: a drying zone, a combustion zone, and an ash zone.

10. A system for dynamic movement of waste through an incinerator, the system comprising:

a stepped hearth combustion chamber including a drying zone, a combustion zone, and an ash zone, at least one combustible material input nearest the drying zone, and at least one outlet nearest the ash zone to permit egress of a product of combustion;

a stair-stepped series of hearths arranged in the stepped hearth combustion chamber;

a plurality of sensing elements including at least one level sensor, each level sensor configured to measure a height of the combustible material on a respective hearth in the series of hearths;

a plurality of response elements including at least one hydraulic ram, each hydraulic ram configured to laterally force the combustible material onto or off of a respective hearth in the series of hearths; and a control system programmable to perform the following:

receiving input from the plurality of sensing elements including the level sensor;

generating at least one output signal as a function of the received input; and transmitting the output signal to the plurality of response elements including the at least one hydraulic ram to selectively transfer respective quantities of the combustible material between the stair-stepped series of hearths, to thereby selectively raise or lower the height of the combustible material on at least one hearth.

11. The system of claim 10, wherein the control system comprises a programmable logic controller, and a hydraulic control system.

12. The system of claim 11, wherein:

the at least one hydraulic ram includes:

at least one hydraulic loading ram configured to laterally force the combustible materials onto a first hearth in the series of hearths; and at least one hydraulic ash transfer ram, each configured to laterally transfer the combustible material to a downstream, stepped-down hearth in the series of hearths; and the plurality of response elements further includes at least one flue gas recirculation system for controlling temperatures within the stepped hearth combustion chamber.

13. The system of claim 11, wherein the plurality of sensing elements include at least a temperature sensor, a gas oxygen content sensor, and the level sensor, wherein each sensing element sends an output signal to the programmable logic controller, wherein the output signal is compared with at least one threshold value stored in the programmable logic controller to affect at least one of the plurality of response elements.

14. The system of claim 13, wherein the temperature sensor is a non-contact infrared temperature sensor for measuring the surface temperature of the combustible materials and the inner surface of the stepped hearth combustion chamber.

15. The system of claim 13, wherein the level sensor is a non-contact level sensor providing continuous combustible material level monitoring.

16. The system of claim 13, further comprising at least one high-temperature imaging camera for observing the combustible material within the stepped hearth combustion chamber.

17. The system of claim 16, wherein the at least one high temperate imaging camera includes an infrared pyrometer.

18. A system for dynamic movement of waste through an incinerator, the system comprising:

a stepped hearth combustion chamber including a stair-stepped series of hearths;

a plurality of sensing elements comprising at least one non-contact temperature sensor, at least one continuous level sensor configured to monitor a height of the combustible material on a respective hearth, and at least one has an oxygen sensor;

a plurality of response elements comprising at least one loading ram configured to load the combustible materials onto a first hearth in the series of hearths and at least one ash transfer ram configured to laterally transfer the combustible material to a respective downstream hearth; and a control system programmable to perform the following;

receiving input from the plurality of sensing elements;

generating output signals as a function of the received input from the plurality of sensing elements; and transmitting the output signals to control the at least one loading ram and the at least one transfer ram to control a loading of the combustible materials onto the first hearth and to control lateral transfer of the combustible material between the series of hearths to facilitate an automated movement of the combustible material through the stepped hearth combustion chamber.

19. The system of claim 18, wherein the control system is further programmable to control the movement of the at least one ash transfer ram dependent on input from the sensing elements.

20. The system of claim 18, wherein the control system is further programmable to automatically control the temperature specific to each zone of the stepped hearth combustion chamber.

* * * * *